US007575137B1

(12) United States Patent
Lederer et al.

(10) Patent No.: US 7,575,137 B1
(45) Date of Patent: Aug. 18, 2009

(54) COVERED NOTEPAD WITH DOCUMENT HOLDER

(75) Inventors: Joshua B. Lederer, Brookline, MA (US); Mark T. Salander, Barrington, RI (US); Agnes Csilla Domotor, W. Medford, MA (US)

(73) Assignee: The Gem Group, Inc., Lawrence, MA (US)

( * ) Notice: Subject to any disclaimer, the term of this patent is extended or adjusted under 35 U.S.C. 154(b) by 909 days.

(21) Appl. No.: 11/096,408

(22) Filed: Apr. 1, 2005

(51) Int. Cl.
*A45F 3/02* (2006.01)

(52) U.S. Cl. ..... 224/601; 224/191; 224/600; 224/623; 224/653

(58) Field of Classification Search ..... 224/188, 224/191, 201, 586, 600, 602, 607, 623, 653, 224/677; 283/75; 40/586, 654.01, 661
See application file for complete search history.

(56) References Cited

U.S. PATENT DOCUMENTS

| | | | | |
|---|---|---|---|---|
| 4,570,688 | A * | 2/1986 | Williams | 150/134 |
| 4,744,497 | A * | 5/1988 | O'Neal | 224/587 |
| 5,059,052 | A * | 10/1991 | Casper | 402/80 R |
| 5,215,237 | A * | 6/1993 | Wu | 224/230 |
| 5,829,657 | A * | 11/1998 | Romer, Jr. | 224/610 |
| D463,665 | S * | 10/2002 | Sloot | D3/303 |
| 6,530,509 | B1 * | 3/2003 | Davis | 224/219 |
| 7,204,398 | B1 * | 4/2007 | Smith, Sr. | 224/607 |
| 7,290,953 | B2 * | 11/2007 | Regala | 401/131 |
| 2005/0055861 | A1 * | 3/2005 | McAnulty | 40/654.01 |

OTHER PUBLICATIONS

George R. Moreau et al., "Magnetic Notepad Holder", U.S. Appl. No. 10/753,710, filed Jan. 8, 2004. Specification and Drawings.
George R. Moreau et al., "Magnetic Notepad Holder", U.S. Appl. No. 10/972,493, filed Oct. 24, 2004. Specification and Drawings.
Joshua B. Lederer, "Notepad with Lanyard and Document Holder", U.S. Design Patent Application, filed on even date herewith, Specification and Drawings.

* cited by examiner

*Primary Examiner*—Nathan J Newhouse
*Assistant Examiner*—Jack H Morgan, Jr.
(74) *Attorney, Agent, or Firm*—William A. Loginov; Loginov & Associates PLLC

(57) ABSTRACT

This invention provides a combination note pad and credential holder having a neck cord or lanyard that passes through a loop in the notepad to allow the item to be worn about the neck at a desired level, typically at chest height. The notepad can include a back cover that supports a writing pad and a hinged front cover, joined to the back cover and selectively opened to access the writing pad. A small pen can be removably attached to a loop between the covers along a side of the writing pad. The bottom edge of the notepad includes a fastener assembly for removably attaching a credential sleeve with a clear window for displaying the user's credential document(s). The sleeve has an open side that allows the documents to be slid thereinto. The fastener assembly can comprise one or more sets of interengaging snaps, look-and-loop members or a zipper-like structure. When not needed, the sleeve can be removed or flipped into a position behind the back cover, out of view. The sleeve can also be removed from the notepad and pinned or clipped in a conventional manner to a separate location on the user's clothing.

10 Claims, 5 Drawing Sheets

COVERED NOTEPAD WITH DOCUMENT HOLDER

BACKGROUND OF THE INVENTION

1. Field of the Invention

This invention relates to notepads and credential or document holders that are worn about the user's neck.

2. Background Information

Badge or credential holders are commonly used at trade shows, events and as regular identification in corporate, government and institutional facilities. Some holders carry a permanent, often laminated document or card with an individual's picture, name and other relevant information (sometimes including recently developed RF identification units). In many settings, such as trade shows, or where individuals are visitors to a site, the holder may be adapted to receive a removable, slide-in document that is presented to the individual on arrival and collected from him or her upon departure. While some credential holders employ a safety pin or snap loop to attach them to the user's clothing, a fairly popular style of holder employs a cord that is worn about the neck and allows the holder to be displayed at chest level. In this manner, the credential holder is always at a predictable and standard location and does not require the user to pin or clip his or her clothing.

Since a neck cord affords significant load-bearing strength to the credential holder and also allows the user to grasp and manipulate it, there is an opportunity to render this item more versatile and useful to the user.

SUMMARY OF THE INVENTION

This invention provides a combination note pad and credential holder having a neck cord or lanyard that passes through a loop in the notepad to allow the item to be worn about the neck at a desired level, typically at chest height. The notepad can include a back cover that supports a writing pad and a hinged front cover, joined to the back cover and selectively opened to access the writing pad. A small pen can be removably attached to a loop between the covers along a side of the writing pad. The bottom edge of the notepad includes a fastener assembly for removably attaching a credential sleeve with a clear or transparent window for displaying the user's credential document(s). The sleeve has an open side that allows the documents to be slid thereinto. The sleeve and fastener assembly are particularly arranged so that the window projects beyond the edges of the covers when they are in a closed position. The fastener assembly can comprise one or more sets of interengaging snaps, look-and-loop members or a zipper-like structure. When not needed, the sleeve can be removed or flipped into a position behind the back cover, out of view. The sleeve can also be removed from the notepad and pinned or clipped in a conventional manner to a separate location on the user's clothing.

In an illustrative embodiment the notepad covers are joined along a side opposite the hinge side by a clasp that selectively secures and releases the covers. The clasp may be secured by snaps, hook-and-loop fastener material, or another acceptable mechanism. The clasp may include the loop through which the neck cord or lanyard passes. In this embodiment, the fastener assembly that removably secures the sleeve is adjacent to the hinge-carrying edge of the notepad, opposite the clasp. The loop may, itself be selectively opened by releasing a hook-and-loop fastener assembly or similar mechanism to release the cord from the notepad. Likewise, the cord may include a quick release mechanism that breaks the cord to prevent accidental strangulation or other entanglement.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
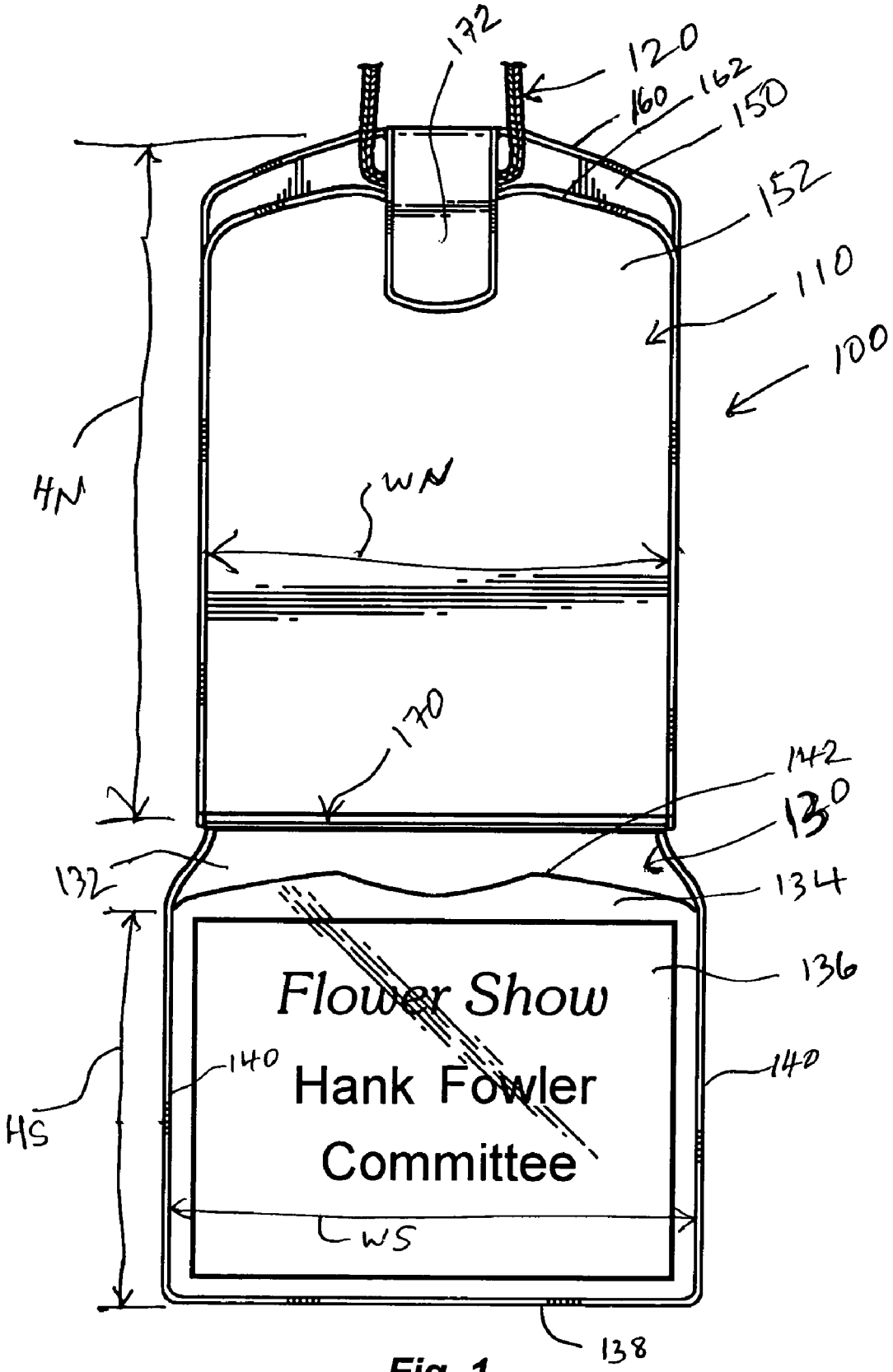
FIG. 1 is a front view of the notepad and credential holder or sleeve in a fully assembled configuration.

FIG. 1 shows a notepad assembly 100 having a covered notepad 110, attached neck cord or lanyard 120 and detachable credential holder or sleeve 130. The sleeve 130 is shown in a viewable position below the covered notepad 110.

The sleeve 130 in this embodiment is generally rectangular. It consists of a piece of base material 132, which may be opaque or transparent/translucent, and an overlying piece of transparent material 134 that allows the documents 136 or other credentials of the wearer to be displayed to the public. The base material can be any acceptable plastic, textile or natural material, including (but not limited to) polyvinylchloride (PVC) sheet, woven cloth, leather, polyethylene sheet, polyurethane sheet, and the like. The base material 132 may be unstiffened and relatively pliable/flexible or can include an optional stiffener (not shown). The stiffener may be formed from paper, cardstock semi-rigid plastic sheet or another acceptable material, including magnetic sheeting that would allow the sleeve to adhere to a ferrometallic surface. Where a stiffener is employed, two plies of base material may sandwich the stiffener to obscure it.

The sleeve's transparent material 134 can be any acceptable transparent material such as PVC or polyethylene. The transparent material 134 is adhered to the base material 132 at three edges, including the bottom 138, as side edges 140. The top edge is not adhered to the base material 132 so that documents can pass into and out of the space defined between the material pieces 132 and 134. It is contemplated that friction will maintain the documents within the space, but a clasp or other sealing mechanism (permanent or temporary) can be used to seal the top edge 142 where there is a risk that documents may fall out of the sleeve. In one embodiment, the base material 132 and transparent material 134 are joined together along the edges 138 and 140 by heat sealing, ultrasonic welding, adhesives or a combination of such techniques. Where cloth or leather-like products are used, the edges can be joined by stitching and/or adhesives. Any other acceptable seamjoining technique is also contemplated. The top edge 142 includes a stylized curve that also aids in lifting the material to allow documents to be inserted and removed.

In this embodiment, the width WS of the document-holding area of the sleeve is approximately 4-6 inches and the height HS is approximately 3-5 inches. However, a variety of shapes and sizes are expressly contemplated. Likewise, the document-holding area can be particularly sized to neatly accommodate certain conventionally sized cards and papers without excess unoccupied space around the edges of the document.

Further referencing FIG. 1, the notepad cover 110 is sized to relative scale with the sleeve in this embodiment. For example, the overall width WN of the notepad cover is approximately 3-6 inches, while the overall height HN is approximately 6-8 inches. These measurements are highly variable and, as described further below can be sized to fit commercially standard writing pads. The notepad cover generally consists of a back cover 150 and a front cover 152. Each cover in this embodiment includes an internal stiffener (not shown) to maintain desired rigidity. The stiffener can be constructed from a variety of materials as described above, including magnetic material as described generally in commonly assigned U.S. patent application Ser. No. 10/972,493 entitled MAGNETIC NOTEPAD HOLDER by George R. Moreau, et al., the teachings of which are expressly incorporated herein by reference. Likewise, the back cover 150 and front cover 152 each include two layers of covering material joined at the outer edges, and sandwiching the respective stiffener. The materials used for each cover 150, 152 are highly variable and they can be joined together at their edges in a variety ways, as described generally above.

The cover material can be continuous, passing beyond the bottom edge of each stiffener to form a unitary hinge 170 along the bottom edge. In alternate embodiments, the stiffener-free portion of the material of one cover can be sewn or otherwise adhered to the edge of the other cover to for the hinge. Similarly, a separate hinge material piece can be adhered to the bottom edge of both covers.

The covers 150 and 152 are removably secured at their respective unhinged top ends 160 and 162 by and overlying clasp 172 that extends from the top edge 160 of the back cover 150 over the top edge 162, and onto the front surface of, the front cover 152. As described further below the front surface and clasp each include one half of a fastener assembly that allows the clasp to be pulled away to thereby hinge open the covers 150 and 152 as desired. While secured together the notepad will not open, making it particularly suitable to be carried about the neck on the lanyard 120.

The lanyard 120 is threaded through a loop (described below) on the surface of the back cover 150 adjacent to its top edge 160. The maximum length of the lanyard is chosen to allow the notepad cover to rest comfortably about the wearer's chest at a desired level when the lanyard 120 is placed around the wearer's neck.

Figure 2:
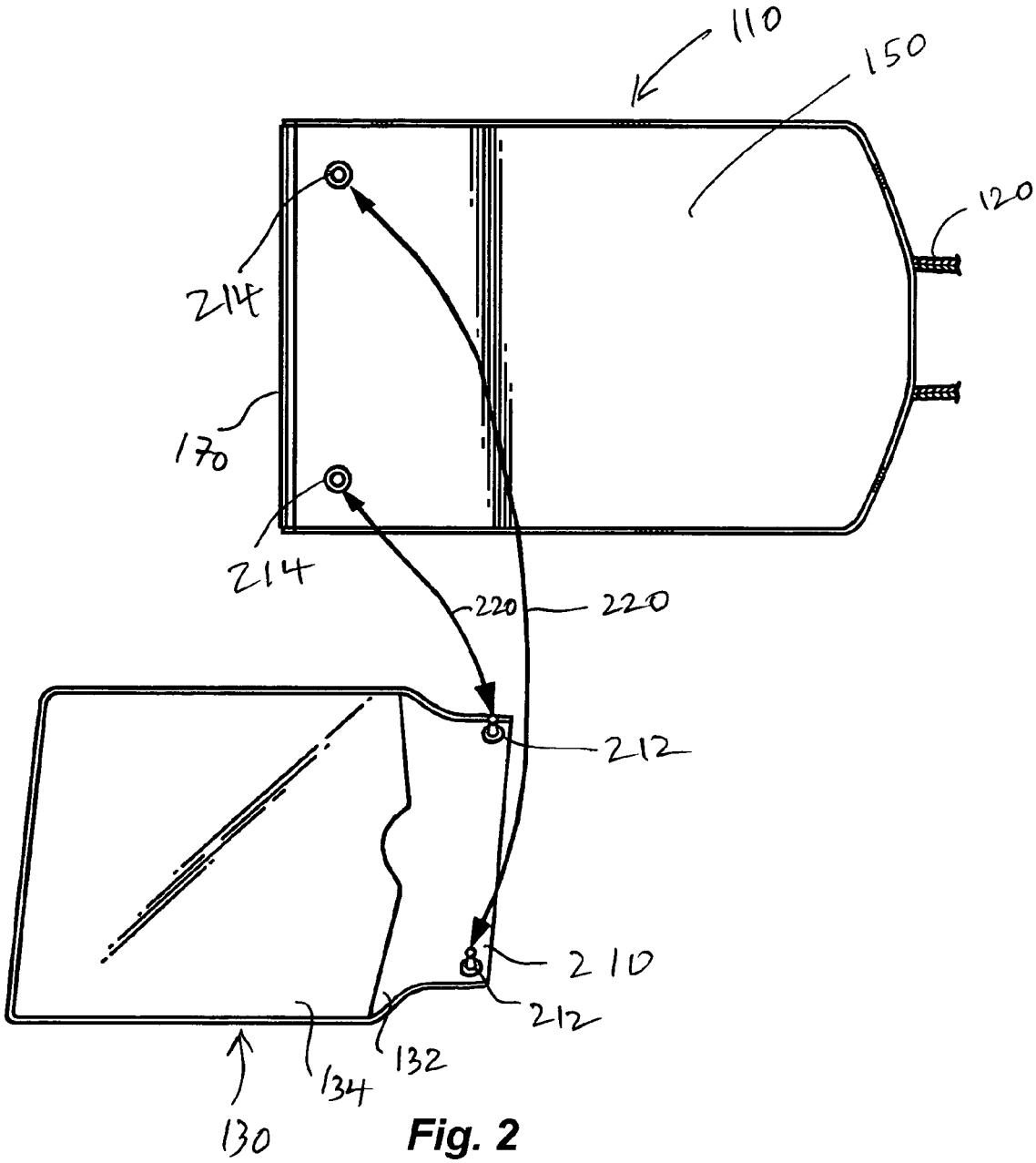
FIG. 2 is an exploded rear perspective view of the back cover of the notepad with the sleeve selectively removed therefrom using interengaging snaps.

With reference to FIG. 2, the sleeve 130 is shown detached from the rear surface of the back cover. The sleeve includes an extension 210 formed at the top edge by the base material 132. The extension, in this embodiment carries a pair of snap fasteners 212. The fasteners interengage with mating snap fasteners 214 mounted just above the bottom edge hinge 170 of the rear face of the back cover 150. The snaps 212, 214 allow the notepad cover 110 and sleeve 130 to be easily attached together and detached (double arrows 220) as desired. This enable the wearer to remove credentials when not needed or hand over credentials for inspection without discarding the useful notepad, which may continue to be worn for use. It should be clear that the fasteners are arranged so that the sleeve window is visible when the two notepad covers are closed. In this orientation, the sleeve window generally extends beyond the edges of the covers sufficiently to allow the enclosed documents to be adequately viewed.

Figure 2A:
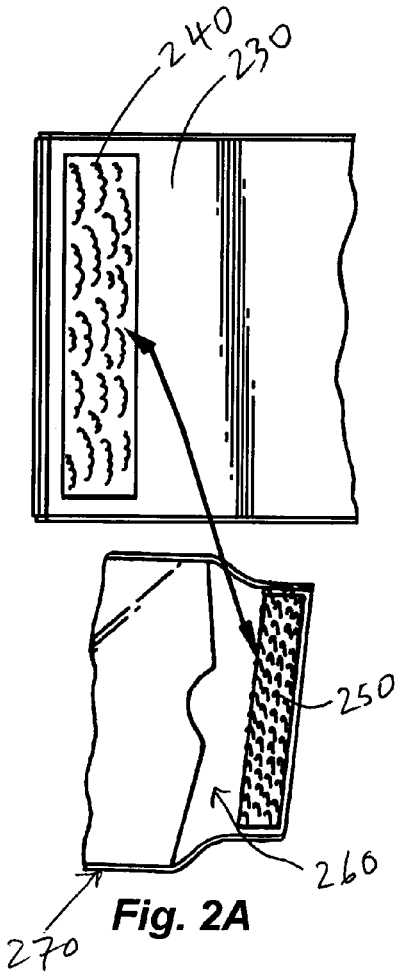
FIG. 2A is a fragmentary exploded perspective view of a notepad back cover and sleeve, according to an alternate embodiment, with the sleeve selectively removed therefrom using interengaging hook-and-loop fastener members.

With brief reference to FIG. 2A, the interengaging fastener assembly used to removably attach the sleeve to the notepad cover is highly variable. In this alternate embodiment, the notepad cover face 230 has a strip of hook-and-loop fastener tape applied thereto. A mating piece of hook-and-loop tape 250 is applied to the extension 260 on the sleeve 270 (the sleeve being otherwise similar in shape, size and construction to the sleeve 130 described above). Any acceptable fastener assembly including, but not limited to, buckles, snaps, clasps magnets and zipper-type fasteners (in any number) can be used to removably attach the sleeve to the notepad. Likewise, while the fastener assembly is attached to particular locations and sides of the sleeve and notepad cover, the fastener system can be applied to other areas on each item within the scope of this invention so long as an effective assembly is maintained in which the notepad is useable and the sleeve allows documents to be viewed at desired times. In fact, in certain embodiments, it may be desirable to apply a permanent fastener between the sleeve and the notepad where removal of the sleeve will not be needed or desired.

Figure 3:
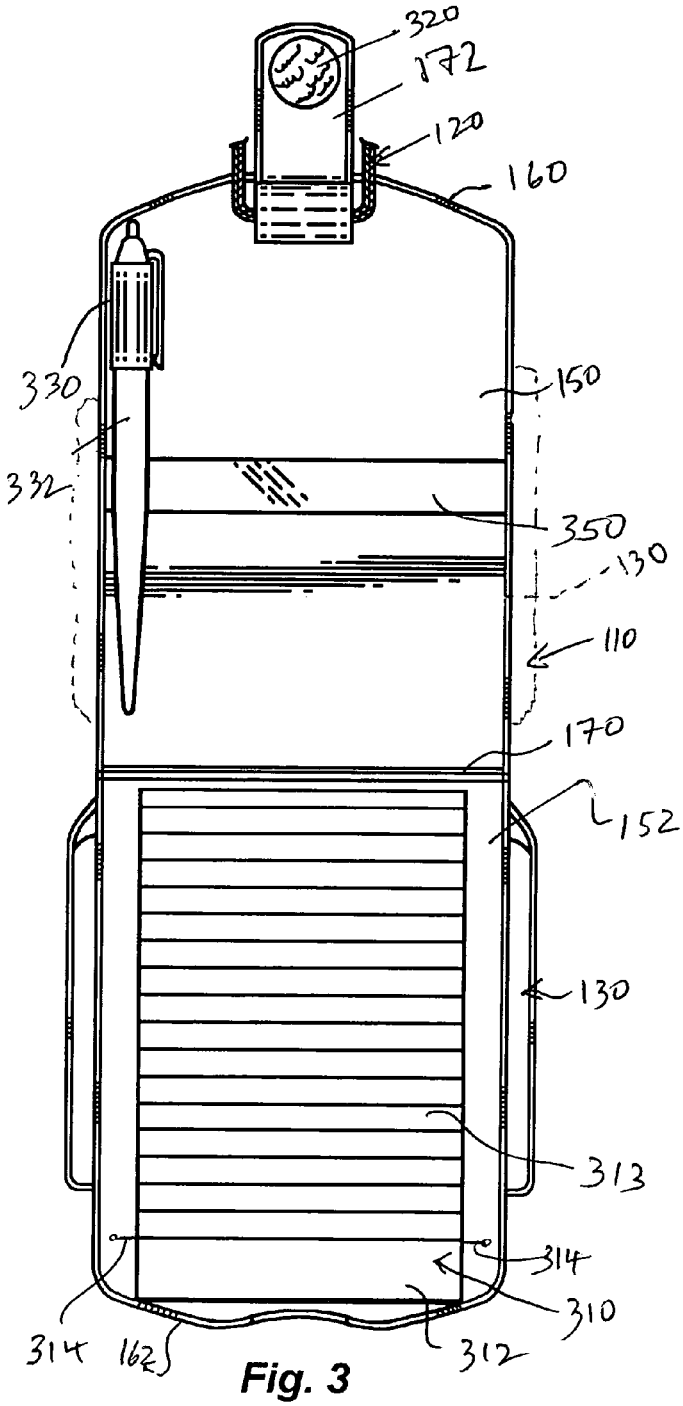
FIG. 3 is a front view of the notepad with the front cover opened to reveal the writing pad and pen and the sleeve stowed in a non-viewable position behind the back cover.

Referring now to FIG. 3, the notepad is shown with the front cover 152 opened to reveal an inner writing pad 310 of conventional size and shape. The pad in this embodiment includes a top binding 312 that is mounted adjacent to the top edge 162 of the front cover 152 and binds together the sheets 313 of paper in the pad 310. A slot 314 is formed in the cover material to receive the cardboard backing plate (not shown, but conventional) of the pad 310. A variety of other mechanisms, including straps and adhesives can be used to secure the pad 310 to the cover 150. It is expressly contemplated that the pad 310 can be oriented in the opposite direction, that is, with its binding 312 near the hinge 170. Also, the pad 310 can be applied (in either orientation) to the inside face of the back cover 150 in an alternate embodiment. In this illustrated implementation, the user wears the notepad cover about his or her neck and opens the notepad cover by removing the clasp, releasing hook and loop clasp fastener 320. This causes the front cover 152 to drop down under force of gravity. This reveals the notepad 310 which, from the wearer's perspective, is now presented "right-side up" to him or her as the wearer grasps the front cover with the non-writing hand and hinges it up into a his or her field of view. The notepad is spaced from the lanyard and user's chest by (at least) the distance of back cover 150, and is thus at a convenient position for writing.

In this embodiment, the back cover includes a pen holding loop 330 and appropriately sized pen, pencil, stylus or other implement 332 that can be removed when needed and reattached thereafter. The location of the implement 332 can be widely varied. To this end the implement 332 and its loop 330 or other holder can be mounted anywhere on either the front or back cover inner/interior faces, along the hinge line, or alternatively, at another location outside of the interior faces of the covers.

Note than an optional strap 350 is mounted between side edges of the inside face of the back cover 150. This strap can support another pad or further documents among other items. Pockets and sleeves (not shown) can also be applied to the outer or inner face or either cover 150, 152 as desired.

As shown in phantom in FIG. 3, the sleeve may be mounted on its fasteners to reside behind the back cover 150 so that it is not readily viewable. This mounting option may be convenient in certain instances, where credentials are not needed or public display is not required, but quick access to the sleeve is still desired.

Figure 4:
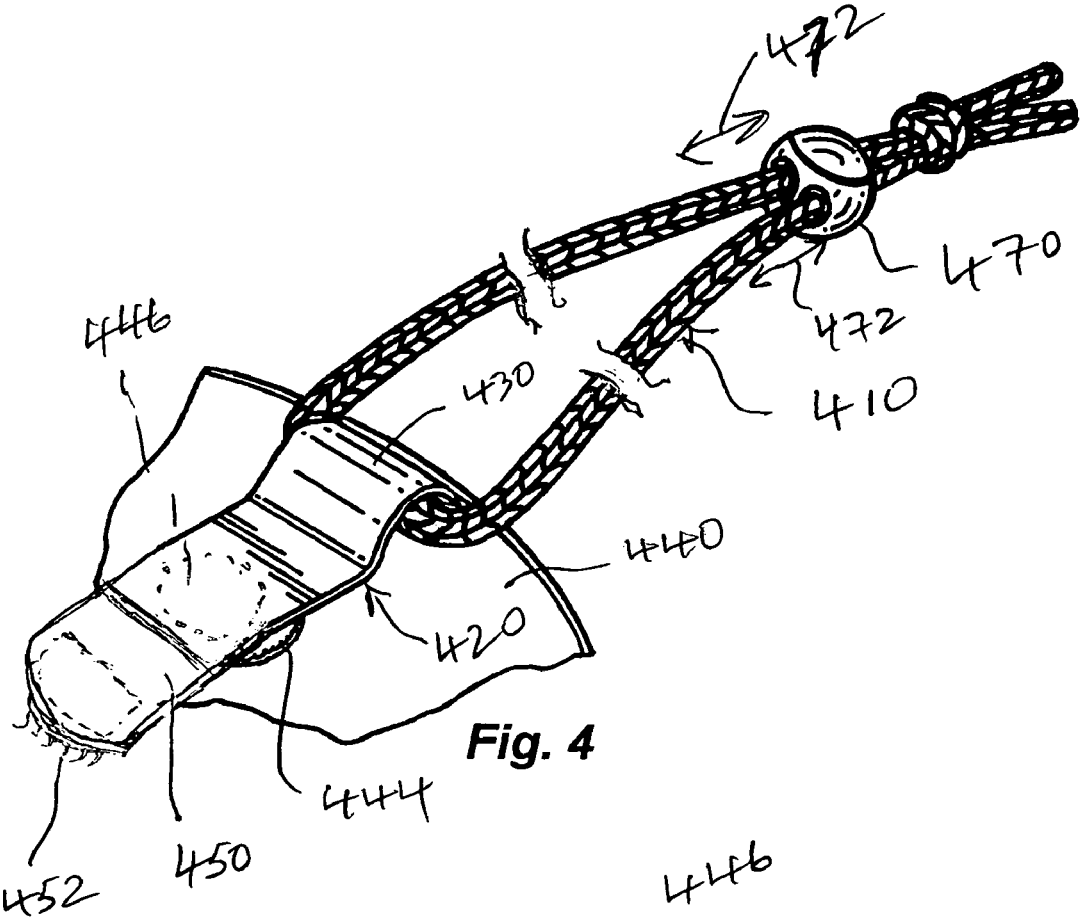
FIG. 4 is a fragmentary perspective view of the loop and clasp assembly according to an embodiment of the invention detailing a releasable loop.
Figure 5:
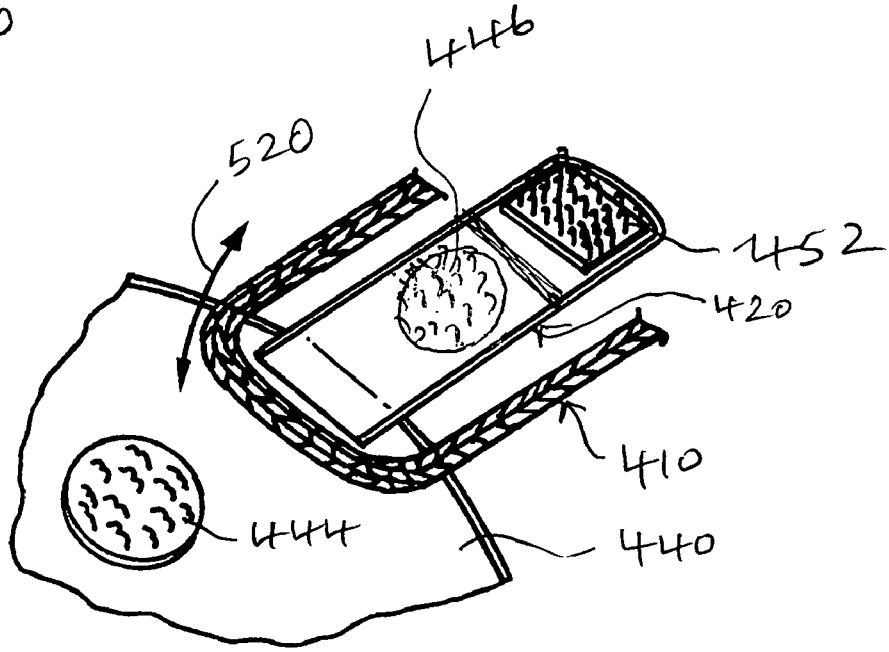
FIG. 5 is a fragmentary perspective view of the loop and clasp assembly of FIG. 4 showing the loop releasing the cord.

Referring now to FIG. 4, the lanyard's securing loop is detailed according to one embodiment. In general, the lanyard may be attached by a wrapped-over strip of material that is welded, sewn or otherwise adhered onto the notepad cover at any appropriate location. In an illustrative embodiment, the lanyard may be permanently fixed to the cover. Alternatively, as shown in FIGS. 4 and 5, the lanyard 410 can be detachably secured to the cover. This allows the notepad to be removed for convenience, and also provides a safety mechanism for quick-release of the notepad, should it become entangled while worn. Other quick-release mechanism can also be provided as described below. In the embodiment of FIG. 4, the lanyard 410 is secured by the clasp mechanism 420 as an added feature. The clasp 420 forms a base loop 430 between its attachment location 432 on the notepad cover 440 and a fastener (hook-and-loop piece) 444. The base loop 430 removably captures the lanyard 410 while the fastener piece 444 is engaged to an opposing fastener piece 446 (shown in phantom in FIG. 4). In this example, the fastener is a hook-and-loop assembly. However, and appropriate fastener mechanism (e.g. snaps, buckles, etc.) can be employed in alternate embodiments. Distally of the lanyard-capturing base loop 430 and fastener pair 444, 446 the end 450 of the clasp 420 carries the fastener piece 452 for securing the covers together as described generally above.

As shown in FIG. 5, the loop 430 may be opened to release the lanyard 410 by separating the fastener pieces 444 and 446. In this example, separation is achieved by drawing (double arrow 520) the clasp 420 away from the cover 440. The lanyard can be selectively attached to the notepad or removed therefrom while the loop is open.

Referring particularly to FIG. 4, the lanyard has an overall length that is sized to accommodate the longest wearing distance expected to be desirable. The lanyard can include an adjustment member 470 that slides (double arrows 472) along the length of the lanyard on each of two sides thereof. The adjustment member in this example is restrained by friction at the desired location along the length of the lanyard. By applying sufficient force the member 470 can be slid to other locations, overcoming the prevailing is friction. This allows the length of the lanyard and associate wear-height of the notepad to be variably adjusted by the user. The member 470 can include a conventional spring-loaded locking member for added holding strength and ease of adjustment according to various embodiments of this invention. Any of the embodiments described herein can contain a length adjustment mechanism. Note also that the lanyards of this invention can be constructed from a variety of synthetic and natural-fiber cordage materials.

Figure 6:
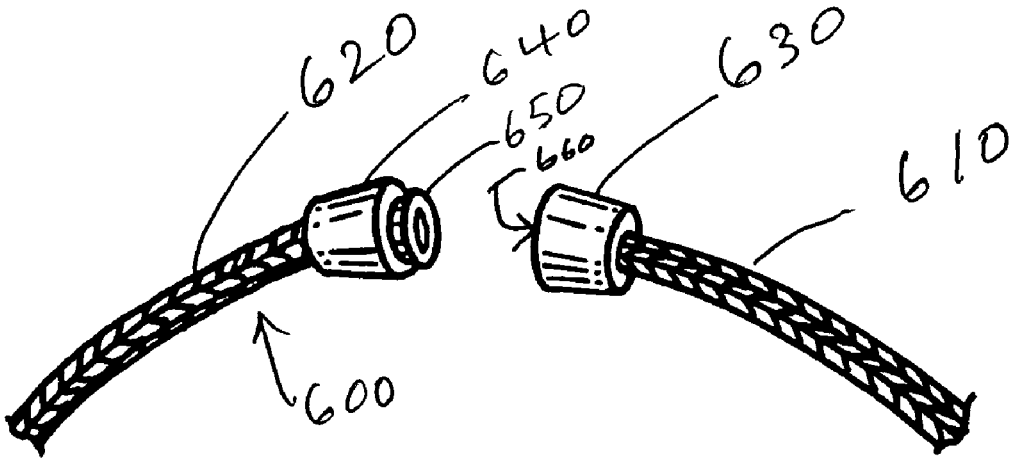
FIG. 6 is a fragmentary perspective view of a quick release cord fastener according to an embodiment of this invention.

Further, it is contemplated that the lanyard may include a safety mechanism or "quick-release" that enables the continuous circuit of the cord to be broken when desired, or when excessive force is applied. This may prevent injury to the neck when the notepad or lanyard becomes entangled. FIG. 6 details a lanyard 600, applicable to any of the embodiments described herein, having a pair of lanyard sides 610 and 620 that are removably attached via respective disconnect pieces 630 and 640. In this exemplary embodiment, the disconnect piece 640 includes a circular shoulder or plug 650 adapted to mate with a socket 660 formed in the other disconnect piece 630. The user joins the pieces 630 and 640 together to render the lanyard continuous by plugging the pieces together with moderate axial force. The pieced 630 and 640 may be drawn apart using similar force in the opposing direction. This force can be user-actuated or can be as the result of a significant drag on the notepad or lanyard 600, such as an unexpected entanglement.

Finally, while the notepad covers of the illustrative embodiment support a paper writing pad, it is expressly contemplated that the notepad shown and described herein can be replaced by, or supplemented with, other items. Thus, the term "notepad", "writing pad" or "pad" as used throughout this specification should be taken broadly to include other items requiring manual or oral interaction by the wearer such as erasable slates (white boards, etc.), telephones, calculators personal digital assistants (PDAs), electronic notepads and books, and other electronic devices, all of which are relatively thin and can be readily housed within front and back clasp-securable covers like those described herein—with such covers having a fixed or removable credential sleeve depending therefrom.

The foregoing has been a detailed description of illustrative embodiments of this invention. Various modifications can be made without departing from the spirit and scope thereof. For example, additional attachments, features and accessories can be applied to any of the components or assemblies described herein to further enhance the usability and functionality of the overall unit. The size, scale and materials of the unit or its components can be varied within reasonable parameters to serve different user requirements. Accordingly, this description is meant to be taken only by way of example and not to otherwise limit the scope of this invention.

What is claimed is:

1. A notepad cover comprising:

a first cover and a second cover, the first cover being joined to the second cover at a hinge and constructed and arranged to cover a pad mounted between the first cover and the second cover when the first cover and the second cover are in a closed position;

a neck cord mounted to the first cover at a location remote from the hinge;

a sleeve having a transparent window mounted to one of the first cover and the second cover so as to project beyond bottom edges of each of the first cover and the second cover when the first cover and the second cover are in the closed position;

a clasp for removably securing the first cover and the second cover together in the closed position; and wherein the clasp is constructed and arranged to removably secure the neck cord with a releasable fastener assembly.

2. The notepad cover as set forth in claim 1 wherein the sleeve is removably attached to one of the first cover and the second cover by a fastener assembly.

3. The notepad cover as set forth in claim 2 wherein the fastener assembly includes a first pair of snaps attached to the first cover on an outside surface adjacent to the hinge.

4. The notepad cover as set forth in claim 3 wherein the fastener assembly includes a second pair of snaps that mate to the first pair of snaps, mounted on an extension of the sleeve remote from the transparent window.

5. The notepad cover as set forth in claim 4 wherein the sleeve is constructed from a plastic sheet having three adjacent edges that are sealed to the window and an open edge adjacent to the extension through which documents can be passed.

6. The notepad cover as set forth in claim 1 wherein the pad comprises a writing pad having paper sheets and a binding.

7. The notepad cover as set forth in claim 1 further comprising a writing instrument mounted between the first cover and the second cover in the closed position.

8. The notepad cover as set forth in claim 1 wherein the sleeve is constructed from a plastic material.

9. The notepad cover as set forth in claim 1 wherein the neck cord is attached to the first cover and the pad is mounted to the second cover so that the pad is oriented to be read by a wearer of the neck cord right-side up when the second cover is opened on the hinge with respect to the first cover.

10. The notepad cover as set forth in claim 1 wherein the neck cord includes a quick-release connection along a length of the neck cord.

* * * * *